US007562713B2

(12) United States Patent
Basmajian et al.

(10) Patent No.: US 7,562,713 B2
(45) Date of Patent: Jul. 21, 2009

(54) DOWNHOLE ACTUATION TOOLS

(75) Inventors: Arin Basmajian, Houston, TX (US); Grigory L. Arauz, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 138 days.

(21) Appl. No.: 11/307,768

(22) Filed: Feb. 21, 2006

(65) Prior Publication Data

US 2007/0193733 A1 Aug. 23, 2007

(51) Int. Cl.
*E21B 34/00* (2006.01)

(52) U.S. Cl. ..... 166/319; 166/321; 166/383; 166/387

(58) Field of Classification Search ..... 166/319, 166/321, 383, 386, 387, 187, 374; 137/68.22
See application file for complete search history.

(56) References Cited

U.S. PATENT DOCUMENTS 4,421,174 A * 12/1983 McStravick et al. ..... 166/374
5,058,673 A * 10/1991 Muller et al. ..... 166/187
5,101,904 A 4/1992 Gilbert
5,443,128 A 8/1995 Amaudric du Chaffaut
5,558,153 A 9/1996 Holcombe
6,145,595 A * 11/2000 Burris, II ..... 166/374
6,321,847 B1 11/2001 Brown
6,354,374 B1 * 3/2002 Edwards et al. ..... 166/297
6,364,023 B1 4/2002 Hiron et al.
6,439,306 B1 8/2002 Patel
6,568,470 B2 5/2003 Goodson, Jr. et al.
6,779,600 B2 8/2004 King et al.
6,782,952 B2 8/2004 Garay et al.
2003/0192687 A1 10/2003 Goodson et al.
2004/0226720 A1 11/2004 Schultz et al.
2005/0279496 A1 12/2005 Fontenot et al.

FOREIGN PATENT DOCUMENTS

EP 0500343 B1 11/1995
FR 2526883 B3 11/1983
GB 2410042 A 7/2005

* cited by examiner

*Primary Examiner*—David J Bagnell
*Assistant Examiner*—Sean D Andrish
(74) *Attorney, Agent, or Firm*—James L. Kurka; Jeremy P. Welch; Trop, Pruner, Hu P.C.

(57) ABSTRACT

Implementations of various technologies are directed to a downhole actuation tool. In one implementation, the downhole actuation tool includes a tubular housing, an oil piston disposed inside the tubular housing, and a first housing disposed inside the tubular housing. The first housing includes an orifice. The downhole actuation tool may further include an oil chamber defined by the oil piston, the first housing and the tubular housing. The oil chamber includes oil. The downhole actuation tool may further include a sliding element disposed inside the tubular housing proximate the first housing.

15 Claims, 4 Drawing Sheets

DOWNHOLE ACTUATION TOOLS

BACKGROUND

1. Field of the Invention

Implementations of various technologies described herein generally relate to downhole actuation tools.

2. Description of the Related Art

The following descriptions and examples are not admitted to be prior art by virtue of their inclusion within this section.

It is often desirable to actuate a downhole tool such as a packer, plug, valve, or test device, after placing the downhole tool in a desired location in a well. Typical prior art devices require a separate intervention run using a tool, such as a mechanical actuator run on a slickline or an electrical actuator run on a wireline. Other intervention tools require a communication link to the surface, such as a hydraulic or electrical control line run in with the tool.

SUMMARY

Described herein are implementations of various technologies for a downhole actuation tool. In one implementation, the downhole actuation tool includes a tubular housing, an oil piston disposed inside the tubular housing, and a first housing disposed inside the tubular housing. The first housing includes an orifice. The downhole actuation tool may further include an oil chamber defined by the oil piston, the first housing and the tubular housing. The oil chamber includes oil. The downhole actuation tool may further include a sliding element disposed inside the tubular housing proximate the first housing.

In another implementation, the downhole actuation tool includes a first atmospheric chamber having a first end and a second end, an oil chamber having a first end and a second end and containing oil, an oil piston disposed between the second end of the first atmospheric chamber and the first end of the oil chamber, and a first housing disposed adjacent the second end of the oil chamber. The first housing has a first end and a second end and comprises at least one orifice disposed therethrough. The downhole actuation tool may further include a second atmospheric chamber disposed adjacent the second end of the first housing. The second atmospheric chamber has a first end and a second end and is configured to receive oil from the oil chamber through the at least one orifice. The downhole actuation tool may further include a second housing disposed adjacent the second end of the second atmospheric chamber. The second housing has a first end and a second end and comprises a port disposed therethrough. The port includes a first rupture disc contained therein. The downhole actuation tool may further include a sliding element disposed proximate the second end of the second housing.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

DETAILED DESCRIPTION

As used here, the terms "up" and "down"; "upper" and "lower"; "upwardly" and "downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
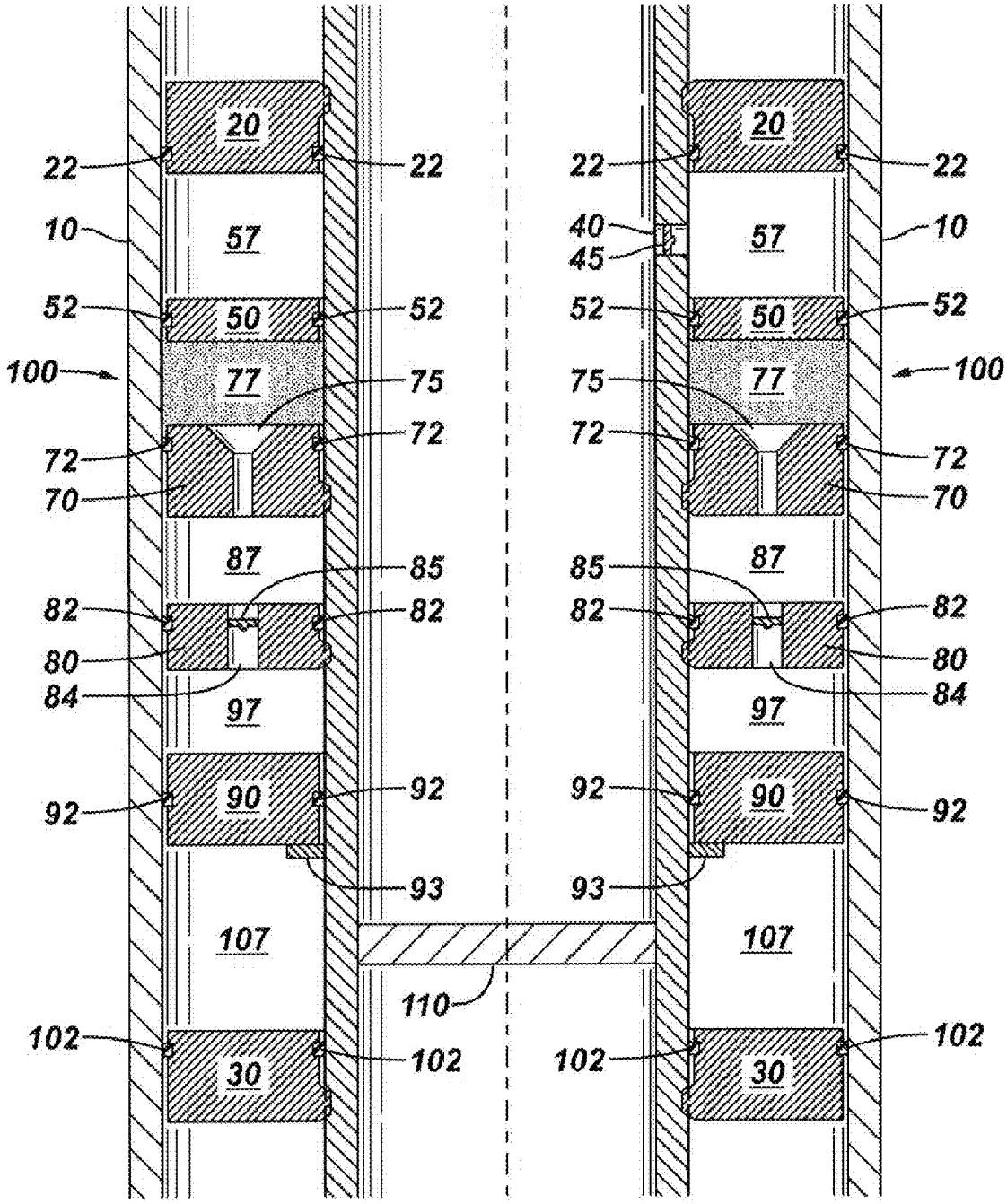
FIG. 1 illustrates a cross sectional view of a downhole actuation tool in accordance with implementations of various technologies described herein.

FIG. 1 illustrates a downhole actuation tool 100 in accordance with implementations of various technologies described herein. In one implementation, the downhole actuation tool 100 may include a tubular housing 10, which may include an upper cap 20 and a lower cap 30, both coupled to the tubular housing 10 by a fastener, threads and the like. The downhole actuation tool 100 may further include a port 40 disposed on an inside diameter of the tubular housing 10. The port 40 may include a first rupture disc 45 disposed therein. The first rupture disc 45 may be rated for a predetermined amount of pressure, which may be based on well conditions, such as the depth to which the downhole actuation tool 100 may be deployed, fluid column and the like.

The downhole actuation tool 100 may further include an oil piston 50. The upper cap 20 and the oil piston 50 may form a first atmospheric chamber 57, which may be sealed with o-rings 22 and 52.

The downhole actuation tool 100 may further include an orifice housing 70 having an orifice 75 disposed therethrough. The orifice 75 may be in the shape of a funnel. However, the orifice 75 may be in any geometrical configuration, such as linear, sinusoidal and the like. Although implementations of various technologies are described herein with reference to the orifice housing 70 having only one orifice, it should be understood that in some implementations the orifice housing 70 may include a series of orifices. The orifice housing 70 may be coupled to the tubular housing 10 by a fastener, threads and the like. The oil piston 50 and the orifice housing 70 may form an oil chamber 77, which contains oil having a predetermined viscosity. The oil chamber 77 may also be sealed with o-rings 52 and 72.

The downhole actuation tool 100 may further include a housing 80 having a hole 84 and a second rupture disc 85 disposed therein. Housing 80 may be coupled to the tubular housing 10 by a fastener, threads and the like. The rupture disc 85 may be rated for a predetermined amount of pressure, which may be based on well conditions, such as the depth to which the downhole actuation tool 100 may be deployed, fluid column and the like. The orifice housing 70 and housing 80 may form a second atmospheric chamber 87, which may be sealed with o-rings 72 and 82.

The downhole actuation tool 100 may further include a sliding sleeve 90 (initially retained in place by a device 93), which may be configured to move downward toward the lower cap 30 when the second rupture disc 85 is ruptured. Although implementations of various technologies are described with reference to a sliding sleeve, it should be understood that some implementations may use other types of releasing mechanism, such as a plunger, a sliding piston and the like. The sliding sleeve 90 and housing 80 may form a third atmospheric chamber 97, which may be sealed with o-rings 82 and 92. In one implementation, the sliding sleeve 90 and the lower cap 30 may also form yet a fourth atmospheric chamber 107, which may be sealed with o-rings 92 and 102. Although various chambers are described with reference to o-rings 60, it should be understood that in some implementations these chambers may be sealed with other sealing means, such as gaskets, metric seals and the like.

The downhole actuation tool 100 may further include a barrier element 110, which may also be referred to as a tubing plug. The barrier element 110 may be configured to hold pressure from above and below. As such, it may be any type of mechanism that would isolate a region above it from a region below it. Such mechanism may include a flapper, a ceramic disc, a glass disc and the like. In one implementation, the barrier element 110 may be disposed between the sliding sleeve 90 and the lower cap 30. However, the barrier element 110 may also be disposed above or below the downhole actuation tool 100. Although the downhole actuation tool 100 may be described with reference to actuating the barrier element 110, it should be understood that in some implementations the downhole actuation tool 100 may be used to actuate other downhole tools/components, such as opening a port, setting a packer, isolating a packer, actuating a control line to a packer-setting piston and the like. In this manner, several downhole operations may be performed without any physical intervention, such as running a wireline tool.

Figure 2:
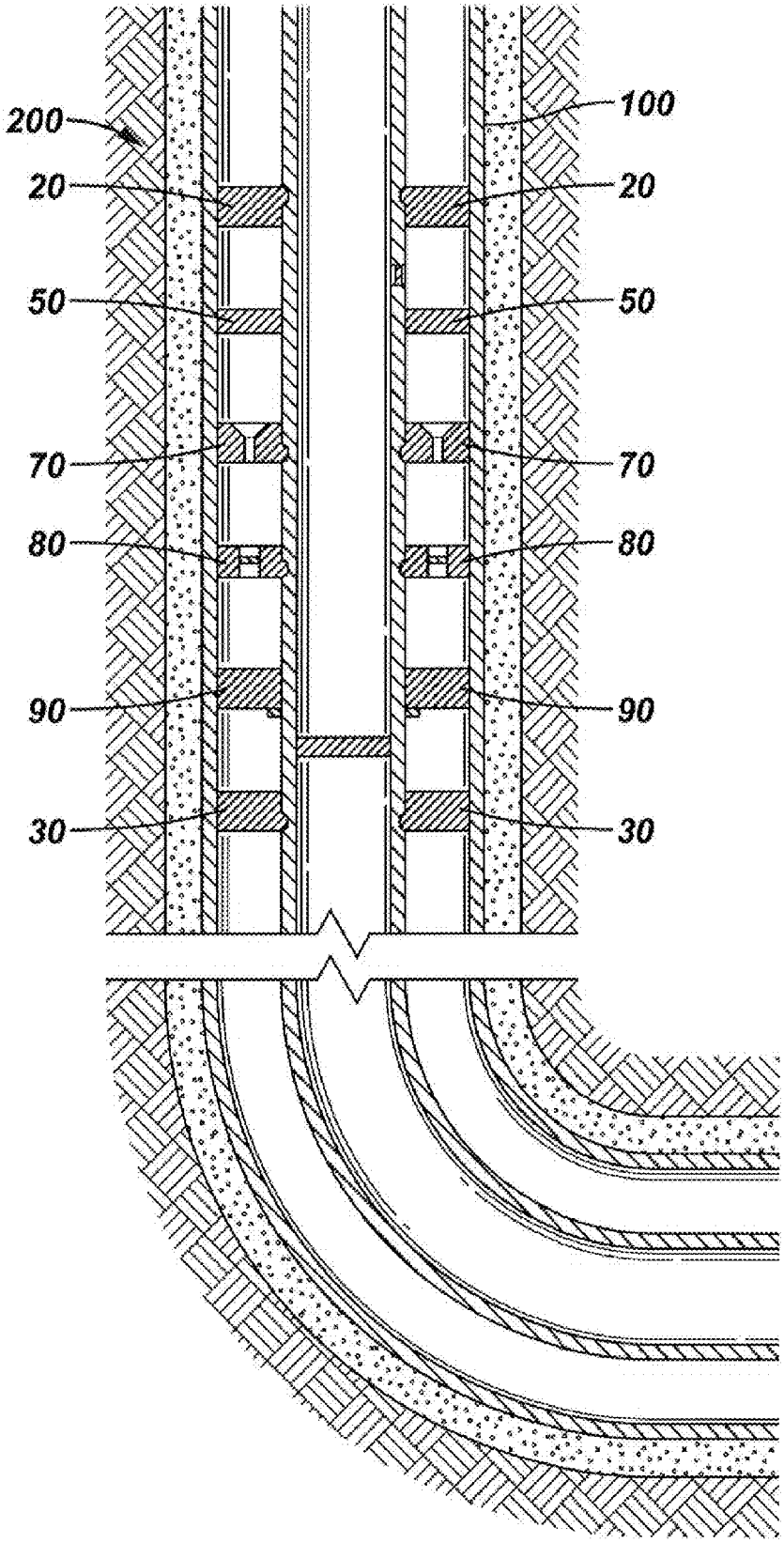
FIG. 2 illustrates a cross sectional view of a tubing string that may include a downhole actuation tool in accordance with implementations of various technologies described herein.
Figure 3:
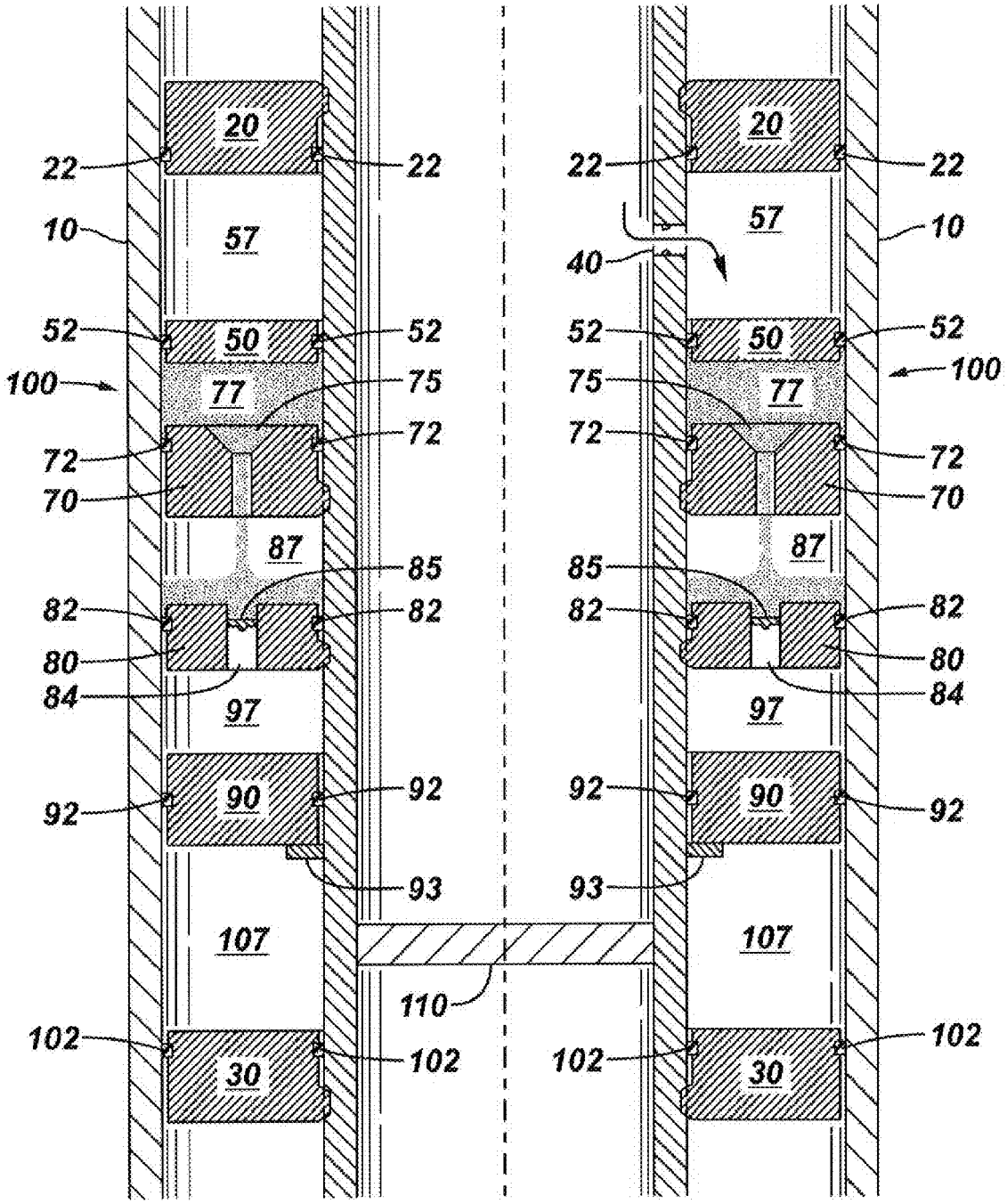
FIG. 3 illustrates a cross sectional view of the downhole actuation tool of FIG. 1 during a pressure testing in accordance with implementations of various technologies described herein.

FIG. 2 illustrates a tubing string 200 that may include a downhole actuation tool 100 in accordance with implementations of various technologies described herein. The tubing string 200 may be pressure tested with the downhole actuation tool 100 attached thereto. As mentioned above, the first rupture disc 45 may be rated for a certain pressure. As such, the first rupture disc 45 may be configured to rupture when a certain depth is reached or when the pressure differential across the first rupture disc 45 exceeds the pressure rating. At a pressure test where the tubing pressure exceeds the pressure rating of the first rupture disc 45, the first rupture disc 45 ruptures, thereby allowing well fluid to enter the first atmospheric chamber 57. The pressure created by the well fluid pushing against the oil piston 50 causes the oil piston 50 to move toward the orifice housing 70, compressing the oil chamber 77 and pushing the oil inside the oil chamber 77 to flow through the orifice 75 into the second atmospheric chamber 87, as shown FIG. 3. Each pressure test typically lasts for a predetermined period of time. As such, at the end of this pressure test, the pressure created by the flow of well fluid into the first atmospheric chamber 57 recedes, thereby causing the oil piston 50 to stop moving and the oil to stop flowing through the orifice 75. Further, at the end of this pressure test, the first rupture disc 45 is ruptured, the oil piston 50 has moved a certain distance toward the orifice housing 70 and the second atmospheric chamber 87 contains some oil from the oil chamber 77.

In one implementation, the first rupture disc 45 may be removed. As such, well fluid may flow into the first atmospheric chamber 57 at anytime.

Figure 4:
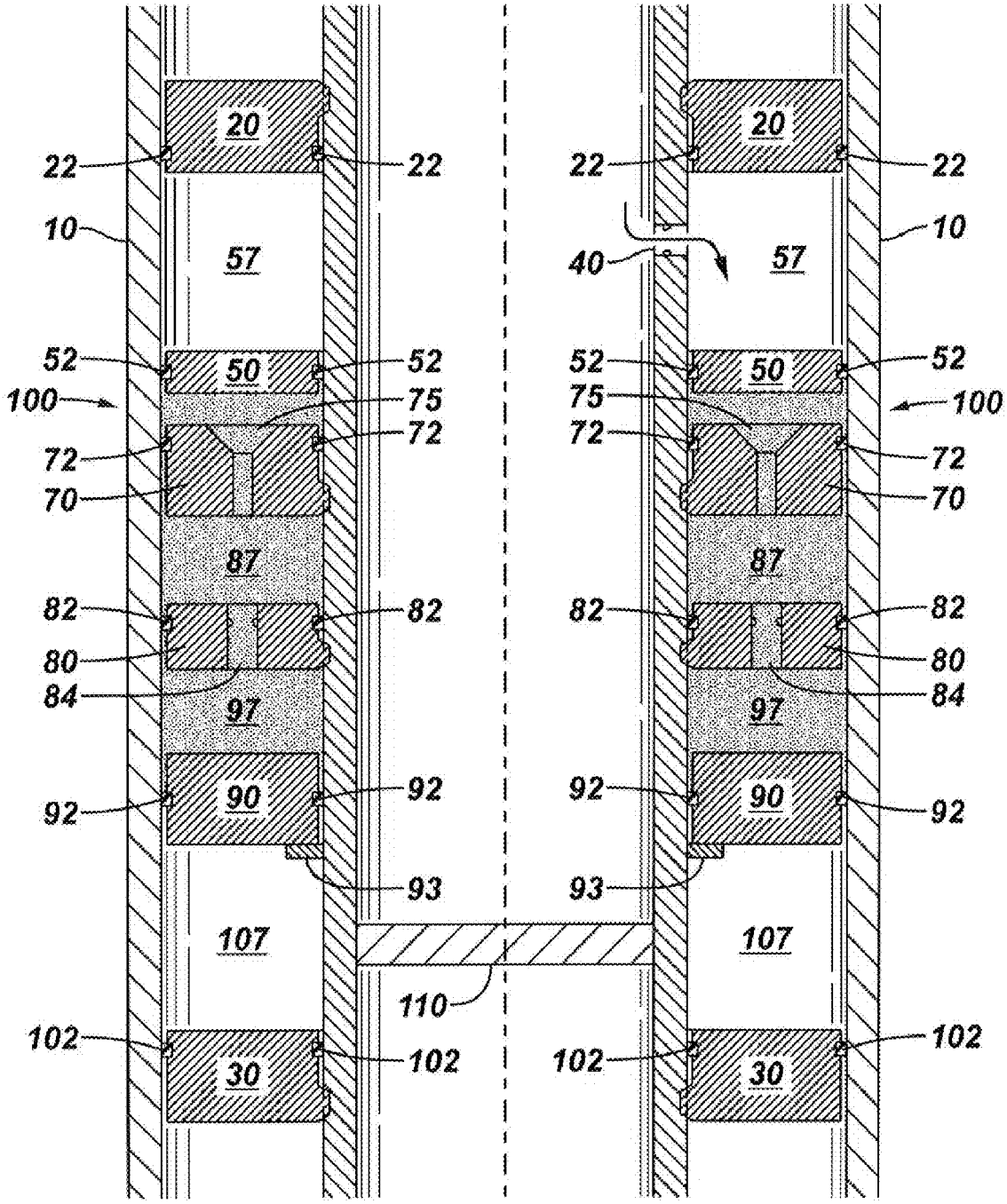
FIG. 4 illustrates another cross sectional view of the downhole actuation tool of FIG. 1 during a pressure testing in accordance with implementations of various technologies described herein.

At a subsequent pressure test, which is typically performed at a greater depth than the first pressure test, pressure may be created again by the well fluid entering the first atmospheric chamber 57, which causes the oil piston 50 to move toward the orifice housing 80 until the second atmospheric chamber 87 is filled with oil, thereby creating a pressure differential across the second rupture disc 85 sufficient to cause the second rupture disc 85 to rupture, as shown in FIG. 4. As a result, the oil from the second atmospheric chamber 87 flows into the third atmospheric chamber 97 and causes the sliding sleeve 90 to actuate the barrier element 110. In one implementation, the sliding sleeve 90 may actuate the barrier element 110 by contacting the barrier element 110. Such contact made by the sliding sleeve 90 may vary from poking, hitting, cracking and the like. Although various implementations have been described with the barrier element 110 being actuated by the sliding sleeve 90 contacting the barrier element 110, it should be understood that, in other implementations, the barrier element 110 may be actuated by the sliding sleeve 90 by any interaction with the sliding sleeve 90 and any other components therebetween that may facilitate the interaction.

The second rupture disc 85 may be rated to withstand a predetermined amount of pressure that may correspond to a certain depth. As such, the pressure rating of the second rupture disc 85 may be used to determine the amount of pressure it would take to actuate the barrier element 110. In one implementation, therefore, the second rupture disc 85 is ruptured only after its pressure rating is exceeded by the tubing pressure.

Although the downhole actuation tool 100 may be configured to rupture the second rupture disc 85 at a pressure test following the pressure test configured to rupture the first rupture disc 45, it should be understood that in some implementations the second rupture disc 85 may be rated to rupture only after a number of pressure tests following the pressure test configured to rupture the first rupture disc 45. Further, although implementations of various technologies have been described with reference to rupture discs, it should be understood that in some implementations shear pins, shear rings and the like may be used in lieu of rupture discs.

In this manner, the downhole actuation tool 100 may be used to actuate the barrier element 110. Although implementation of various technologies are described with reference to the sliding sleeve 90 actuating the barrier, it should be understood that some implementations may use other types of releasing mechanism, such as a plunger, a sliding piston and the like, to actuate the barrier element 110. Likewise, although various implementations are described with reference to actuating the barrier element 110, it should be understood that some implementations may be configured to actuate other downhole tools, such as a packer, a plug and the like.

According to implementations of various technologies described herein, the downhole actuation tool 100 may be configured to provide an operator a predetermined amount of time to pressure test the tubing string 200 before the barrier element 110 is actuated. This predetermined amount of time may be based on the oil viscosity, the diameter of the orifice 75, the length of the orifice 75, the size of the second atmospheric chamber 87 and the size of the oil chamber 77.

In one implementation, the housing 80 for the second rupture disc 85 along with the second rupture disc 85 may be removed. As such, oil would flow directly from the orifice 75 to the third atmospheric chamber 97 against the sliding sleeve 90. In such an implementation, the predetermined amount of time may be based on the oil viscosity, the diameter of the orifice 75, the length of the orifice 75, and the size of the oil chamber 77.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A downhole tool, comprising:

a tubular housing defining an annular space;

an oil piston disposed inside the annular space;

a first member disposed inside the annular space and comprising an orifice;

an oil chamber disposed in the annular space defined by the oil piston, the first member and the tubular housing, wherein the oil chamber comprises oil;

a sliding element disposed inside the annular space, wherein the first member is located between the oil piston and the sliding element;

a second chamber to receive oil communicated through the orifice in response to actuation of the oil piston;

a third chamber in fluid communication with the sliding element to receive oil communicated from the second chamber; and a second member between the sliding element and the first member, wherein the second member comprises a port having a rupture disc contained therein and in fluid communication with the third chamber to block all communication of the oil from the second chamber to the third chamber until the second chamber fills with oil communicated from the oil chamber.

2. The downhole tool of claim 1, wherein the orifice has a funnel shape.

3. The downhole tool of claim 1, further comprising a lower cap disposed proximate the sliding element.

4. The downhole tool of claim 1, further comprising an upper cap disposed inside the tubular housing and another port disposed on an inside diameter of the tubular housing between the upper cap and the oil piston.

5. The downhole tool of claim 4, wherein said another port comprises another rupture disc.

6. The downhole tool of claim 1, wherein the rupture disc has a pressure rating that corresponds to a depth to which the downhole tool will be deployed.

7. The downhole tool of claim 1, wherein the rupture disc ruptures when the tubing pressure exceeds a pressure rating of the rupture disc.

8. The downhole tool of claim 1, wherein the sliding element is a sliding sleeve.

9. The downhole tool of claim 1, wherein the second and third chambers comprise atmospheric chambers.

10. A downhole tool, comprising:

a first atmospheric chamber having a first end and a second end;

an oil chamber comprising oil, the oil chamber having a first end and a second end;

an oil piston disposed between the second end of the first atmospheric chamber and the first end of the oil chamber;

a first housing disposed adjacent the second end of the oil chamber, wherein the first housing has a first end and a second end and comprises at least one orifice disposed therethrough;

a second atmospheric chamber disposed adjacent the second end of the first housing, wherein the second atmospheric chamber has a first end and a second end and is configured to receive oil from the oil chamber through the at least one orifice;

a sliding element;

a third atmospheric chamber in fluid communication with the sliding element to receive oil communicated from the second atmospheric chamber;

a second housing disposed adjacent the second end of the second atmospheric chamber, wherein the second housing has a first end and a second end and comprises a first port disposed therethrough, wherein the first port comprises a rupture disc contained therein to block all communication of the oil from the second atmospheric chamber to the third atmospheric chamber until after the second atmospheric chamber fills with oil communicated from the oil chamber.

11. The downhole tool of claim 10, wherein the first ends comprise upper ends and the second ends comprise lower ends.

12. The downhole tool of claim 10, further comprising an upper cap disposed adjacent the first end of the first atmospheric chamber and a lower cap disposed proximate the sliding element.

13. The downhole tool of claim 10, further comprising a second port adjacent the first atmospheric chamber and another rupture disc disposed in the second port to provide entry of well fluid into the first atmospheric chamber.

14. The downhole tool of claim 10, wherein the rupture disc is configured to rupture when the tubing pressure exceeds a pressure rating of the rupture disc.

15. A method usable with a well, comprising:

providing a tubular housing defining an annular space;

disposing an oil piston inside the annular space;

disposing a first member inside the annular space, the first member comprising an orifice;

providing at least one rupture disc to control all fluid communication with a sliding member disposed inside the annular space; and moving the oil piston to actuate the sliding member, the actuation of the sliding member comprising rupturing said at least one rupture disc, wherein the first member is located between the oil piston and the sliding element.

* * * * *